US006413115B2

(12) United States Patent
Hio et al.

(10) Patent No.: US 6,413,115 B2
(45) Date of Patent: Jul. 2, 2002

(54) INSULATION-DISPLACEMENT TERMINAL FITTING

(75) Inventors: Masahide Hio; Eiji Kojima, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/885,762

(22) Filed: Jun. 20, 2001

(30) Foreign Application Priority Data

Jun. 29, 2000 (JP) ..... 2000-196593

(51) Int. Cl.[7] ..... H01R 4/24; H01R 4/26; H01R 11/20

(52) U.S. Cl. ..... 439/397

(58) Field of Search ..... 439/397, 399, 439/406, 407, 400

(56) References Cited

U.S. PATENT DOCUMENTS 5,934,928 A 8/1999 Endo et al. ..... 439/397

6,113,417 A * 9/2000 Furutani et al. ..... 439/397

FOREIGN PATENT DOCUMENTS

| | | |
|---|---|---|
| EP | 0 352 966 B1 | 5/1990 |
| EP | 1 058 342 | 12/2000 |
| GB | 2 028 600 | 3/1980 |
| JP | 57-10550 | 2/1982 |
| JP | 2-195664 | 8/1990 |

* cited by examiner

*Primary Examiner*—Brian Sircus
*Assistant Examiner*—Javaid Nasri
(74) *Attorney, Agent, or Firm*—Anthony J. Casella; Gerald E. Hespos

(57) ABSTRACT

A connector has opposed side walls (12) with a wire-receiving space therebetween. Insulation displacement portions (17) are cantilevered from the side walls (12) by cutting portions of the side walls (12) and bending the cut portions into the wire-receiving space. Bent portions (17A) are formed by bending free ends (17B) of the insulation-displacement portions (17) back toward the respective side wall (12).

11 Claims, 6 Drawing Sheets

INSULATION-DISPLACEMENT TERMINAL FITTING

BACKGROUND OF THE INVENTION

1. Field of the Invention

The invention relates to an insulation-displacement terminal fitting.

2. Description of the Related Art

A known insulation-displacement terminal fitting includes opposed side walls and a wire-receiving space between the side walls, as disclosed in Japanese Examined Patent Publication No. 57-10550. Opposed V-shaped insulation-displacement portions are press-formed to project from the respective side walls and into the wire-receiving space. The insulation-displacement terminal fitting is used with a wire that can be pushed transversely into the wire-receiving space. As a result, the insulation-displacement portions cut through a resin coating of the wire and contact a core of the wire at the cut-open sections of the resin coating.

The V-shaped insulation-displacement portions in the side walls of the conventional insulation-displacement terminal fitting are thinned and elongated during their press-formation. However, excessive elongation may reduce the strength of the insulation-displacement portions. Furthermore, there are limits to the projecting distances of the insulation-displacement portions from the side walls.

In view of the above, it is an object of the present invention to provide an insulation-displacement terminal fitting with insulation-displacement portions that are not thinned and elongated excessively.

SUMMARY OF THE INVENTION

The invention is directed to an insulation-displacement terminal fitting with opposed side walls and a wire receiving space between the side walls. Insulation-displacement portions are cantilevered from the side walls and project into the wire-receiving space. The insulation-displacement portions each have a base end at the respective side wall, a projecting end in the wire receiving space and an intermediate bend between the base end and the projecting end. The intermediate bends of the insulation-displacement portions cut the resin coating on a wire that is pushed transversely into the wire receiving space. Further pushing of the wire brings the intermediate bends of the respective insulation-displacement portions into contact with the core of the wire at the cut-open sections of the resin coating.

The insulation-displacement portions are formed by making cuts in the side walls and folding the cut portions inwardly. The intermediate bends are formed by bending an intermediate portion of each cantilevered insulation-displacement portion back toward the corresponding side walls.

Openings are made in the side walls by the cutting, folding and bending that forms the insulation-displacement portions, and the insulation-displacement portions extend from edges of the respective openings. Each insulation-displacement portion is folded away from the respective opening and then is bent back toward the inner surface of the respective side wall. Insertion of the wire into the wire-receiving space creates forces on the insulation-displacement portions that tends to urge the insulation-displacement portions outwardly and away from the wire-receiving space. Accordingly, the space between opposed insulation-displacement portions could be increased, and the effectiveness of the contact between the insulation-displacement portions and the core of the wire could be reduced. However, such outward displacement of the insulation-displacements portion during insertion of the wire is restricted by contact between the extending ends of the insulation-displacement portions and the inner surface of the respective side wall. Accordingly, a reliable contact and a specified contact pressure with the core of the wire can be achieved.

Forces created during insertion of the wire into the wire-receiving space also tend to flatten the intermediate bends. Such flattening could increase the distance between opposed intermediate bends, and hence could reduce the effectiveness of the contact between the insulation-displacement portions and the core of the wire. To prevent such reduced effectiveness, the side walls of the insulation-displacement terminal of the subject invention may be formed with stoppers. The stoppers are disposed to engage the extending ends of the insulation-displacement portions. Thus, the stoppers restrict flattening of the intermediate bends and substantially prevent associated displacements of the extending ends of the insulation-displacement portions in directions parallel to the side walls. Accordingly, the distance between opposed insulation-displacement portions remains substantially constant during insertion of the wire into the wire receiving space.

Insulation-displacement portions may be formed in two positions on each side wall, such that the insulation-displacement portions on each side wall are spaced apart in the longitudinal direction of the wire. The two insulation-displacement portions on each side wall preferably extend in opposite directions with respect to the longitudinal direction of the wire.

The insulation-displacement portions are cantilevered from the side walls, and therefore are not thinned and elongated like conventional insulation-displacement portions that have opposite ends supported on side walls.

Additionally, the insulation-displacement portions will not be displaced in directions away from the wire. Therefore, a specified contact pressure can be secured between the insulation-displacement portions and the wire.

Furthermore, the stoppers restrict flattening of the insulation-displacement portions. Hence, the projecting distances of the insulation-displacement portions from the side walls are not reduced, and a specified contact pressure can be achieved between the insulation-displacement portions and the wire.

DETAILED DESCRIPTION OF THE PREFERRED EMBODIMENTS

Figure 1:
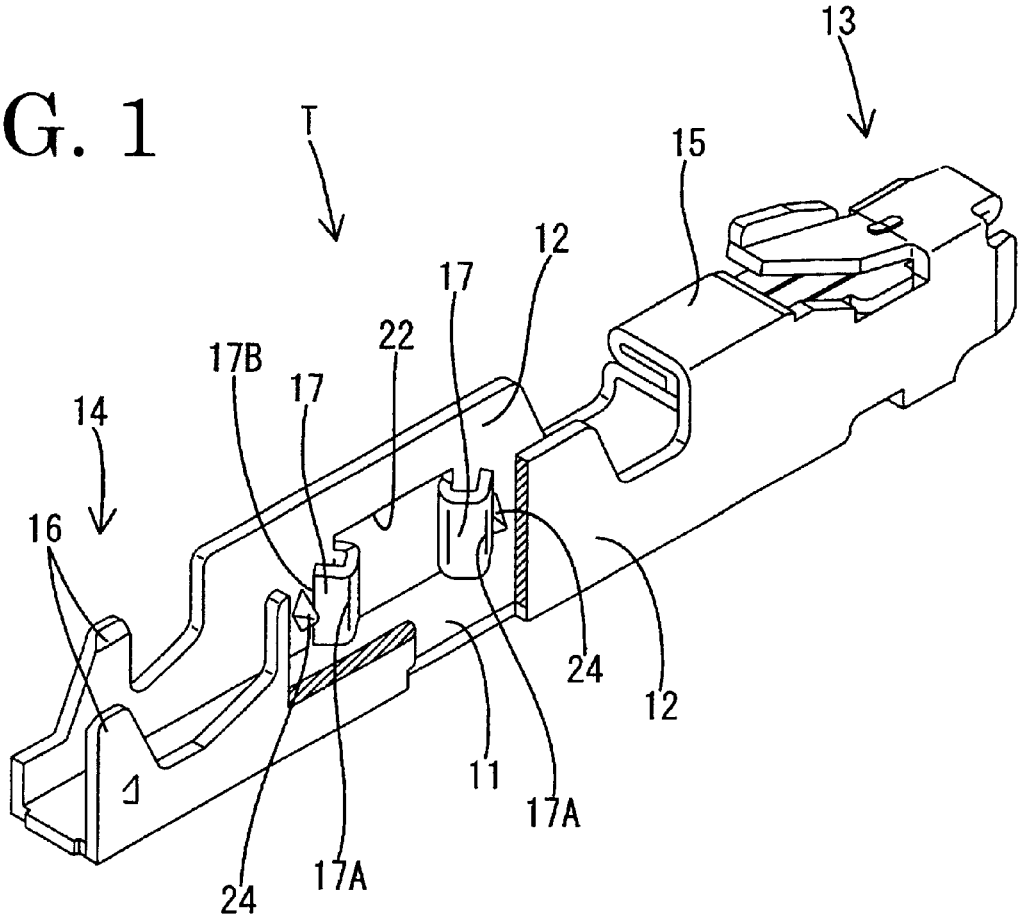
FIG. 1 is a perspective view partly cut away of a first embodiment.
Figure 2:
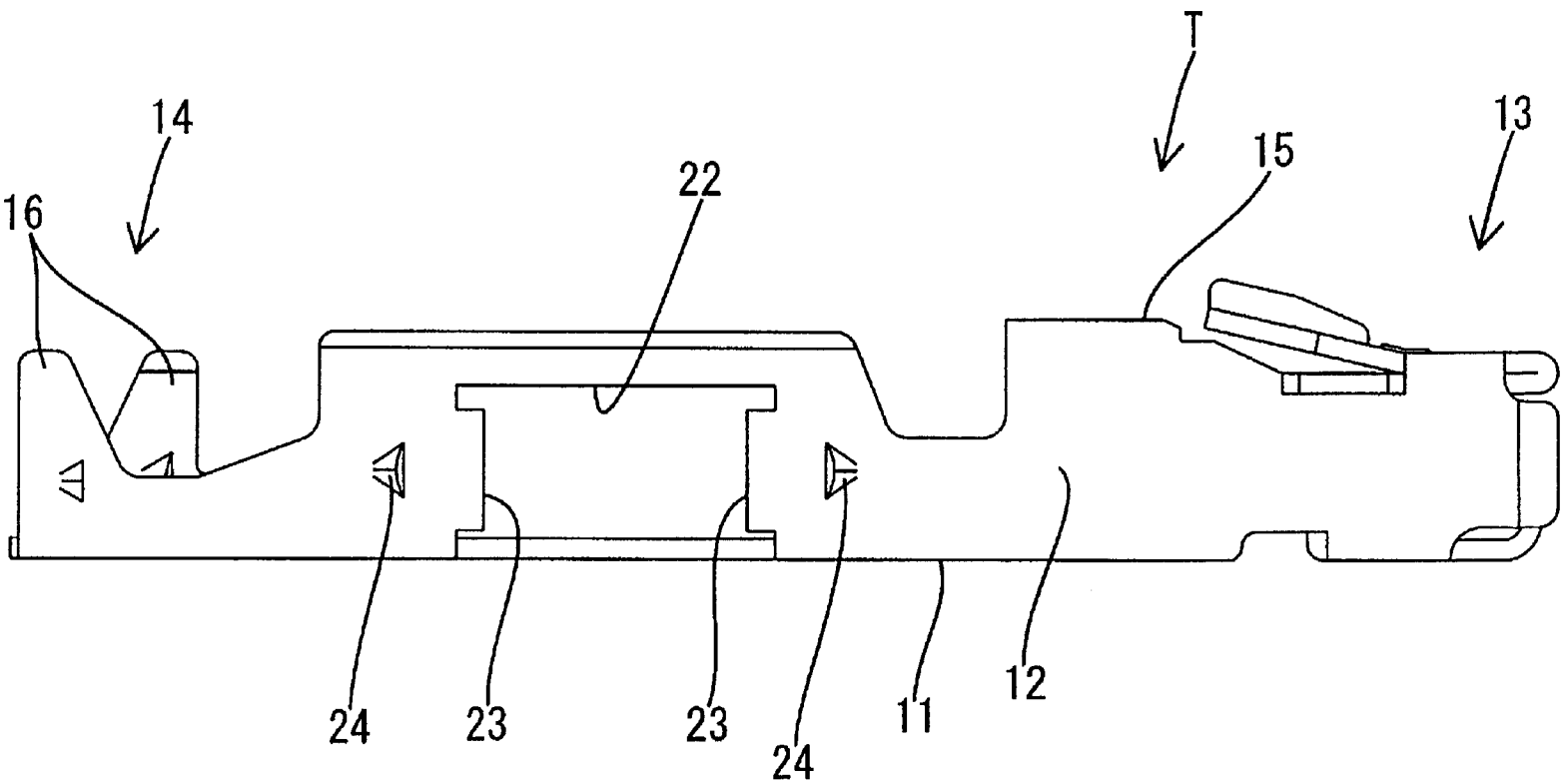
FIG. 2 is a side view of the first embodiment.

An insulation-displacement terminal fitting according to a first embodiment of the invention is identified by the letter T in FIGS. 1–5, and is produced by bending to a conductive metallic plate that has been stamped or cut into a specified shape. The insulation-displacement terminal fitting T has a narrow bottom wall 11 and two side walls 12 that extend up from opposite side edges of the bottom wall 11 over its entire length. An engaging portion 13 is formed at the front end of the terminal fitting T for connection with a mating male terminal fitting (not shown), and a crimping portion 14 is formed at the rear end of the terminal fitting T for crimped connection with a wire W. Insulation-displacement portions 17 are formed between the front and rear ends for connection with the wire W.

The engaging portion 13 is comprised of the front end of the bottom wall 11,front ends of the side walls 12 and ceiling walls 15. The ceiling walls extend inwardly from the upper edges of the front ends of the side walls 12 and are placed one over the other. Thus, the engaging portion 13 is in the form of a rectangular tube that extends in forward and backward directions. The crimping portion 14 is comprised of the rear end of the bottom wall 11, and crimping pieces 16 formed at the rear ends of the side walls 12. The crimping pieces 16 are offset from each other in forward and backward directions, and are crimped into connection with the wire W placed between the side walls 12. The crimping step may be performed simultaneously with or before or after a step of insulation displacement to be described later.

Two longitudinally spaced insulation-displacement portions 17 are formed in each of the side walls 12. Thus, a total of four insulation-displacement portions 17 are provided. The four insulation-displacement portions 17 are disposed to define a front pair and a rear pair, and with the insulation-displacement portions 17 in each pair being arranged transversely to hold the wire W therebetween.

Figure 5:
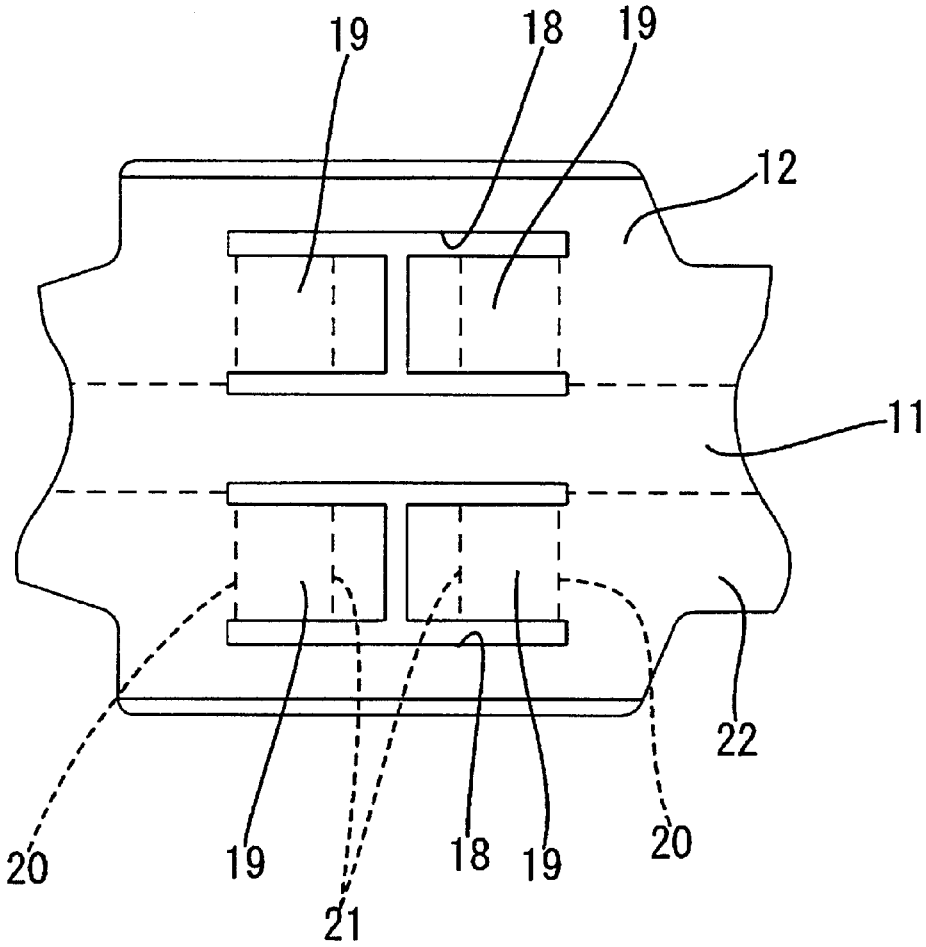
FIG. 5 is a partial development of the first embodiment.

Before bending and embossing the terminal fitting T, each side wall 12 is formed with an H-shaped slit 18, as shown in FIG. 5. Each H-shaped slit 18 defines substantially rectangular front and rear tabs 19. Each tab 19 is folded about 90° to 150° along a fold line 20 at the base of the respective tab 19 such that each tab 19 projects in a common direction from the metallic plate that will form the insulation-displacement terminal fitting T. More particularly, each tab 19 is folded away from the other tab 19 on the respective side wall 12. Thus the front tab 19 in each side wall 12 is folded forwardly and the rear tab 19 in each side wall 12 is folded rearwardly.

Each tab 19 also is bent back toward the respective side wall 12 about a bend line 21 that is substantially parallel to the respective fold line 20 and that is disposed at an intermediate position on the tab 19. The intermediate bends at the bend lines 21 each extend through an angle of approximately 90° to 150°. The combination of the fold at location 20 and the bend at location 21 effectively converts each tab 19 of FIG. 5 into one of the insulation-displacement portions 17 shown in FIGS. 1–4.

Figure 3:
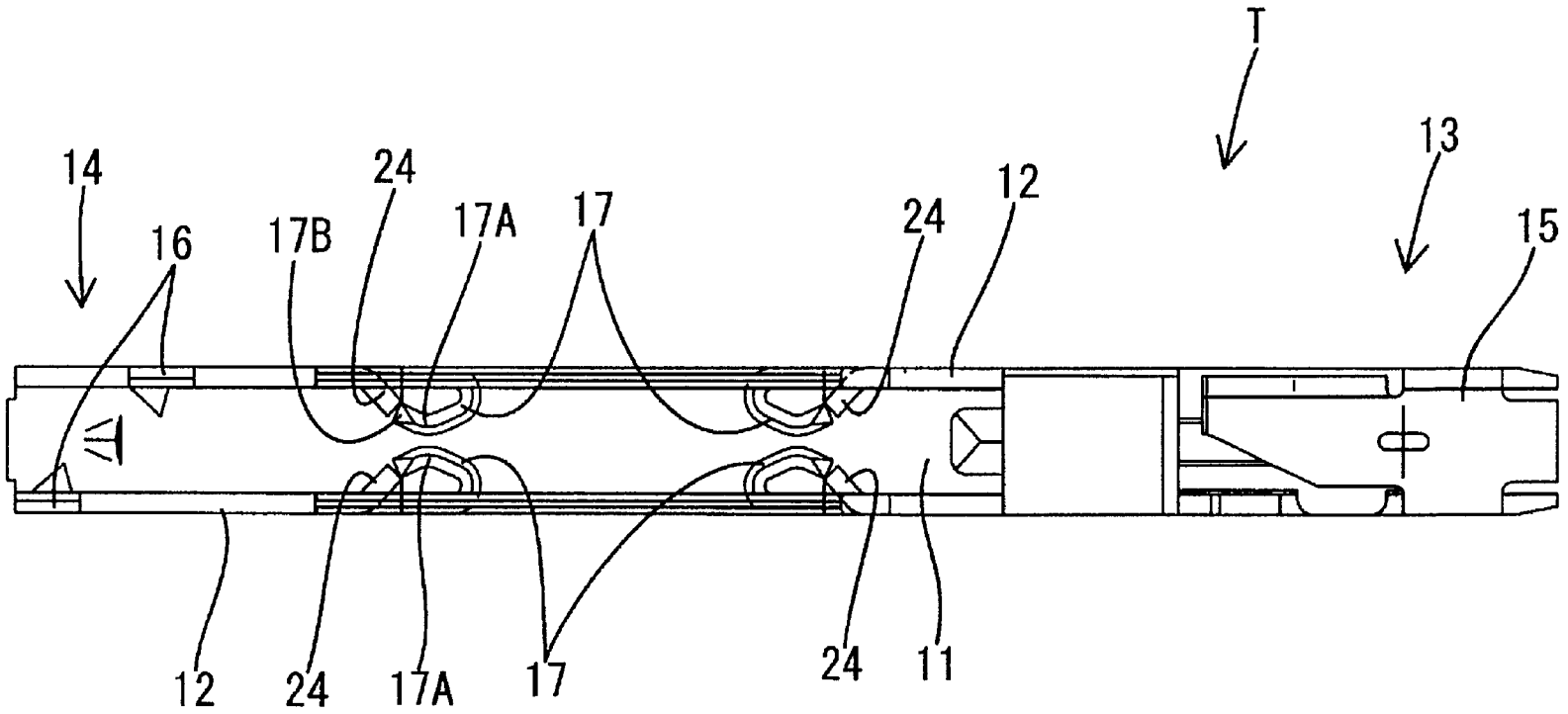
FIG. 3 is a plan view of the first embodiment.
Figure 4:
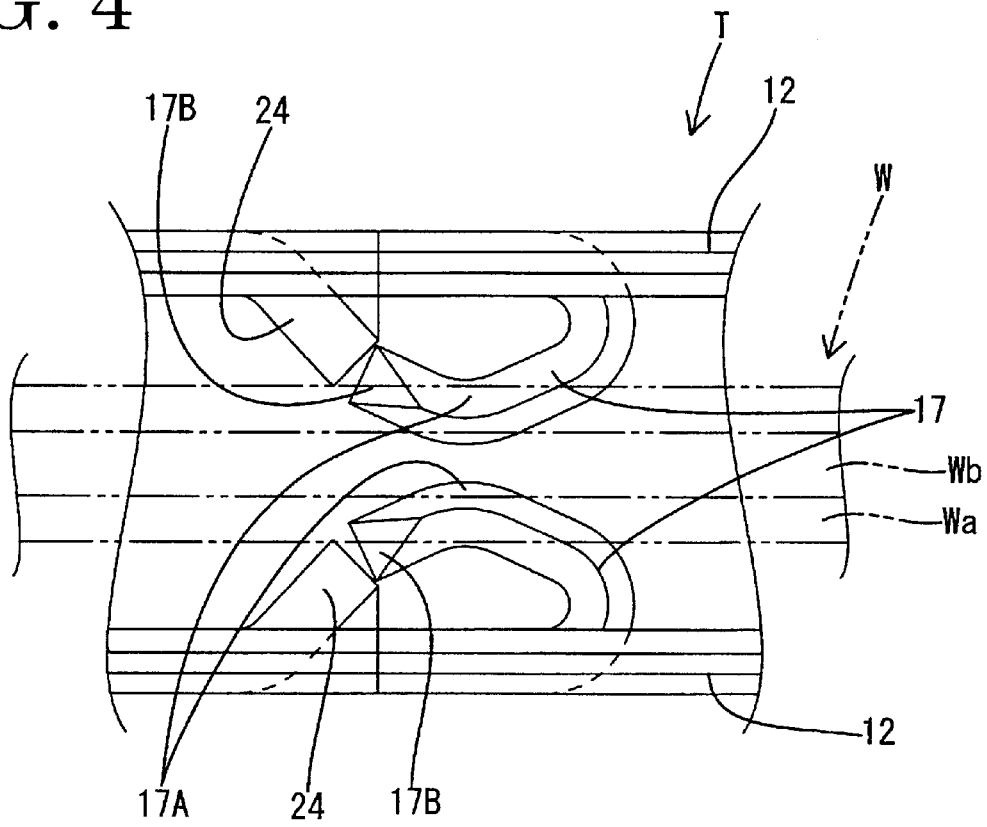
FIG. 4 is a partial enlarged horizontal section of the first embodiment.

Each insulation-displacement portion 17 cantilevers inwardly from the respective side wall 12 at the fold line 20, and is bent back toward the side wall 12 at the intermediate bend line 21. Thus, the insulation-displacement portion 17 has a triangular bent portion 17A when viewed from above, as shown in FIG. 3.

The formation of the insulation-displacement portion 17 creates an opening 22 in the side wall 12, and the insulation-displacement portion 17 extends from an edge 23 of the opening 22. Additionally, each insulation-displacement portion 17 is folded and bent in a direction away from the corresponding opening 22.

Each cantilevered insulation-displacement portion 17 includes an extending end 17B that is spaced slightly from the inner surface of the corresponding side wall 12. Sections of each insulation-displacement portion 17 between the bend 17A and the extending end 17B are aligned obliquely to the respective side wall 12.

The side walls 12 are formed with stoppers 24 that are embossed inwardly for engaging the extending ends 17B of the insulation-displacement portions 17. The stoppers 24 are disposed to engage the forward extending ends 17B of the front insulation-displacement portions 17 from front and to engage the backward extending ends 17B of the rear insulation-displacement portions 17 from behind. Thus, the stoppers 24 prevent forward and backward displacement of the extending ends 17B and flattening deformations of the bent portions 17A of the insulation-displacement portions 17 that could increase distances between each insulation-displacement portion 17 and the opposing side wall 12.

The transversely arranged insulation-displacement portions 17 in each pair are symmetrical with each other, and the two insulation-displacement portions 17 formed in the same side wall 12 also are symmetrical with each other. The minimum spacing between the bent portions 17A in each pair of the transversely arranged insulation-displacement portions 17 is slightly smaller than the outer diameter of a core Wb of the wire W.

The insulation-displacement terminal fitting T is used by aligning the longitudinal axis of the wire W parallel to the longitudinal direction of the terminal fitting T and parallel to the side walls 12. The wire W then is pushed transversely into the wire-receiving space between the side walls 12 of the insulation-displacement terminal fitting T. Pushing forces on the wire W cause the bent portions 17A to cut the resin coating Wa of the wire W open between the respective pairs of the transversely arranged insulation-displacement portions 17. Hence the bent portions 17A bite into the cut-open sections of the resin coating Wa and contact the core Wb.

The insulation-displacement portions 17 in this embodiment are formed so that their free ends extend from the side walls 12. Thus, the insulation-displacement portions 17 are thicker than those formed by bending, thinning and elongating portions of the side walls to project inwardly. Additionally, plating at the outer surfaces of the insulation-displacement portions 17 is free from cracking and peeling.

The prior art insulation-displacement portions become thinner as the projecting distance from the side walls 12 increases. However, in this embodiment, the insulation-displacement portions 17 do not become thinner regardless of the projecting distances of the insulation-displacement portions 17 from the side walls 12. Thus, the projecting distances of the insulation-displacement portions 17 from the side walls 12 and distances between opposed insulation-displacement portions 17 can be set in accordance with dimensions of the core Wb and independently of limitations on permitted thinning of the metal.

If the insulation-displacement portions were deformed by displacing their extending ends forward or backward, then the distances between opposed insulation-displacement portions would increase, and contact pressure with the wire W would decrease. However, the stoppers 24 are formed in the side walls 12 of this embodiment to restrict the deformation of the insulation-displacement portions 17. Hence, the projecting distances of the insulation-displacement portions 17 from the side walls 12 are not reduced, and a specified contact pressure can be secured between the insulation-displacement portions 17 and the wire W.

Figure 6:
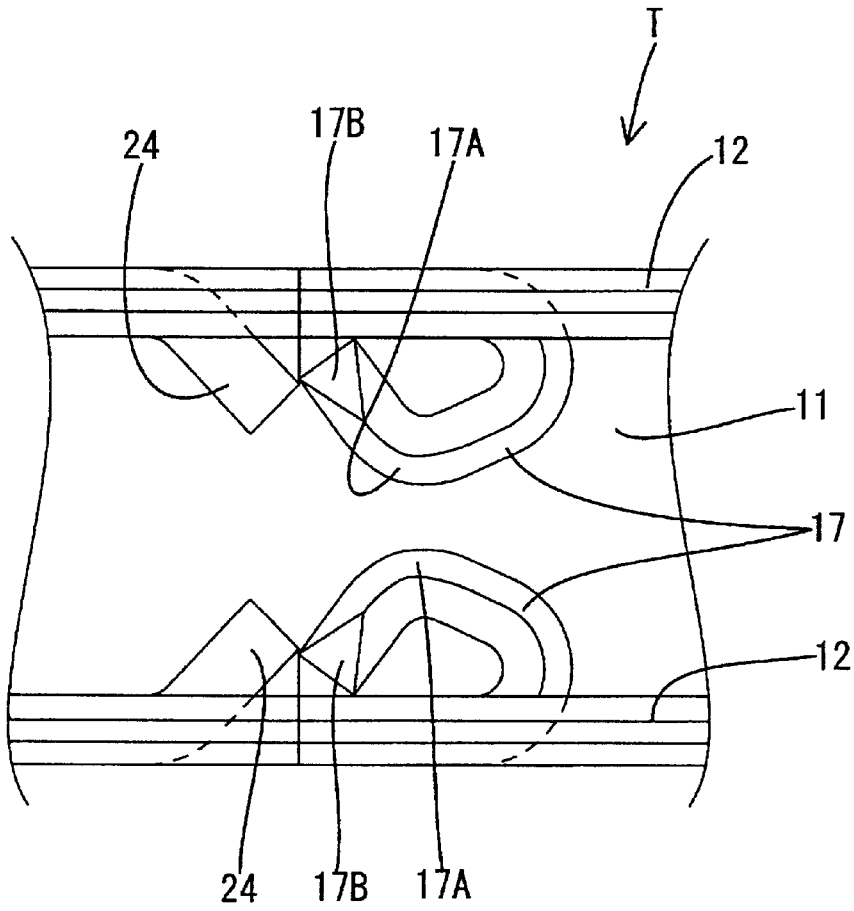
FIG. 6 is a partial enlarged horizontal section of a second embodiment.

A second embodiment of the invention is illustrated in FIG. 6. The second embodiment differs from the first embodiment in the positional relationship between the extending ends 17B of the insulation-displacement portions 17 and the side walls 12. Other elements of the FIG. 6 embodiment are the same as in the first embodiment. Therefore, no description is given on the structure, action and effects of those similar elements, and they are merely identified by the same reference numerals.

The extending ends 17B of the insulation-displacement portions 17 in the first embodiment are spaced away from the side walls 12. However, the extending ends 17B of the insulation-displacement portions 17 in the FIG. 6 embodiment have corners in contact with the inner surfaces of the side walls 12. This eliminates the possibility of displacements of the bent portions 17A of the insulation-displacement portions 17 in directions away from the wire W and toward the respective side wall 12. As a result, a specified contact pressure between the insulation-displacement portions 17 and the core Wb of the wire W can be ensured. Further, the engagement of the stoppers 24 with the extending ends 17B of the insulation-displacement portions 17 restrict sliding movements of the extending ends 17B on the side walls 12 and associated flattening of the bent portions 17B of the insulation-displacement portions 17 that would otherwise increase the distances to the opposing side walls 12.

The present invention is not limited to the above described and illustrated embodiment. For example, the following embodiments are also embraced by the technical scope of the present invention. Beside the following embodiments, various changes can be made without departing the spirit of the present invention.

Although the insulation-displacement portions extend in directions away from the openings in the side walls, they may extend toward the openings according to the present invention.

Although two pairs of front and rear insulation-displacement portions are provided in the foregoing embodiment, one, three or more pairs of insulation-displacement portions may be provided according to the present invention.

What is claimed is:

1. An insulation-displacement terminal fitting for use with a wire, the wire having a core and a resin coating surrounding the core, the insulation-displacement terminal fitting comprising: first and second opposed side walls defining a wire-receiving space therebetween, first and second insulation-displacement portions cut from portions of the respective side walls and folded to cantilever into the wire receiving space, each said insulation-displacement portion having a bent portion in the wire-receiving space and an extending end extending from the bent portion back toward the respective side wall from which the respective insulation-displacement portion is cantilevered, whereby the resin coating of the wire pushed into the wire receiving space is cut open by the bent portions of insulation-displacement portions, such that the core of the wire is brought into contact with the bent portions, wherein openings are cut into the respective side walls for forming the insulation-displacement portions, each said opening having a plurality of edges, each said insulation-displacement portion having a base end unitary with the respective side wall at one of said edges, each said insulation-displacement portion being folded about the base end away from the respective opening, and wherein the side walls are formed with stoppers disposed for engaging the extending ends of the insulation-displacement portions for restricting movements of the extending ends substantially parallel with the side walls.

2. The insulation-displacement terminal fitting of claim 1, wherein each said side wall is formed with two of said insulation-displacement portions folded in opposite directions from opposed side edges of the respective opening in the respective side wall.

3. The insulation-displacement terminal fitting of claim 1, wherein the bent portions each define bend angles of between 90–150 degrees.

4. An insulation-displacement terminal fitting for use with a wire, the wire having a core and a resin coating surrounding the core, the insulation-displacement terminal fitting comprising: first and second opposed side walls defining a wire-receiving space therebetween, first and second insulation-displacement portions cut from portions of the respective side walls and folded to cantilever into the wire receiving space, each said insulation-displacement portion having a bent portion in the wire-receiving space and an extending end extending from the bent portion back toward the respective side wall from which the respective insulation-displacement portion is cantilevered, whereby the resin coating of the wire pushed into the wire receiving space is cut open by the bent portions of insulation-displacement portions, such that the core of the wire is brought into contact with the bent portions, wherein the extending ends of the respective insulation-displacement portions contact inner surfaces of the respective side walls.

5. The insulation-displacement terminal fitting of claim 4, wherein openings are cut into the respective side walls for forming the insulation-displacement portions, each said opening having a plurality of edges, each said insulation-displacement portion having a base end unitary with the respective side wall at one of said edges, each said insulation-displacement portion being folded about the base end away from the respective opening.

6. The insulation-displacement terminal fitting of claim 5, wherein the side walls are formed with stoppers disposed for engaging the extending ends of the insulation-displacement portions for restricting movements of the extending ends substantially parallel with the side walls.

7. An insulation-displacement terminal fitting comprising: a bottom wall with opposite side edges, opposed side walls extending from the respective side edges of the bottom wall and defining a wire-receiving space therebetween, a pair of opposed insulation-displacement portions cantilevered respectively from the side walls and folded into the wire receiving space, each said insulation-displacement portion having a base end unitary with the respective side wall, an extending end remote from the base end and a bent portion between the base end and the extending end, sections of each said insulation-displacement portion between the bent portion and the extending end being bent back toward the respective side wall from which the respective insulation-displacement portion is cantilevered, at least one stopper formed on each said side wall and projecting into the wire receiving space at a location such that the extending end of each said insulation-displacement portion is between the base end thereof and the corresponding stopper, whereby the stoppers restrict flattening of the bent portions.

8. The insulation-displacement terminal fitting of claim 7, wherein each said side wall comprises two of said insulation-displacement portions disposed such that the insulation-displacement portions on the respective side walls are substantially opposed to one another.

9. The insulation-displacement terminal fitting of claim 8, wherein the insulation-displacement portions on each said side wall are folded in opposite directions.

10. An insulation-displacement terminal fitting comprising: a bottom wall with opposite side edges, opposed side walls extending from the respective side edges of the bottom wall and defining a wire-receiving space therebetween, a pair of opposed insulation-displacement portions cantilevered respectively from the side walls and folded into the wire receiving space, each said insulation-displacement portion having a base end unitary with the respective side wall, an extending end remote from the base end and a bent portion between the base end and the extending end, sections of each said insulation-displacement portion between the bent portion and the extending end being bent back toward the respective side wall from which the respective insulation displacement portion is cantilevered, stopper means formed on each said side wall for restricting flattening of the bent portions.

11. The insulation-displacement terminal fitting of claim 10, wherein each said stopper means is substantially adjacent the extending end of one of said insulation-displacement portions.

* * * * *